US007762092B2

(12) United States Patent
Tikhonov et al.

(10) Patent No.: US 7,762,092 B2
(45) Date of Patent: Jul. 27, 2010

(54) ICE MAKING DEVICE AND REFRIGERATOR HAVING THE SAME

(75) Inventors: Alexei Tikhonov, Suwon-si (KR); June Kee Min, Seongnam-si (KR); Myung Hoon Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 654 days.

(21) Appl. No.: 11/594,828

(22) Filed: Nov. 9, 2006

(65) Prior Publication Data

US 2008/0264082 A1 Oct. 30, 2008

(30) Foreign Application Priority Data

Dec. 8, 2005 (KR) ..... 10-2005-0120031
Jan. 21, 2006 (KR) ..... 10-2006-0006592

(51) Int. Cl.
*F25C 1/12* (2006.01)

(52) U.S. Cl. ..... 62/186; 62/353

(58) Field of Classification Search ..... 62/186–187, 62/340–356
See application file for complete search history.

(56) References Cited

U.S. PATENT DOCUMENTS 3,025,679 A * 3/1962 Keighley ..... 62/71
3,382,682 A * 5/1968 Frohbieter ..... 62/72
5,182,916 A * 2/1993 Oike et al. ..... 62/135
6,351,955 B1 * 3/2002 Oltman et al. ..... 62/71
6,438,988 B1 * 8/2002 Paskey ..... 62/353
7,152,424 B2 * 12/2006 Shoukyuu et al. ..... 62/351
7,266,973 B2 * 9/2007 Anderson et al. ..... 62/351

FOREIGN PATENT DOCUMENTS

JP 02-89978 3/1990
JP 11-173736 7/1999

OTHER PUBLICATIONS

English translation of the Chinese Office Action, Jun. 6, 2008 (8 pgs.).

* cited by examiner

*Primary Examiner*—William E Tapolcai
(74) *Attorney, Agent, or Firm*—Staas & Halsey LLP

(57) ABSTRACT

An ice making device and a refrigerator having the ice making device include an ice making tray having ice making grooves opened at upper sides thereof to receive water and a cool air flow channel disposed below the ice making grooves and along which cool air flows. Cool air is uniformly supplied from one side to the other side of the ice making tray along the cool air flow channel, and therefore, the ice making process is completed in a reduced time.

17 Claims, 10 Drawing Sheets
(2 of 10 Drawing Sheet(s) Filed in Color)

ICE MAKING DEVICE AND REFRIGERATOR HAVING THE SAME

CROSS-REFERENCE TO RELATED APPLICATION

This application claims the benefit of Korean Patent Application No. 2005-120031 and No. 2006-6592, filed on Dec. 8, 2005 and Jan. 21, 2006 in the Korean Intellectual Property Office, the disclosure of which is incorporated herein by reference.

BACKGROUND OF THE INVENTION

1. Field of the Invention

The present invention relates to an ice making device and a refrigerator having the same, and, more particularly, to an ice making device that is capable of uniformly freezing water received in an ice making tray, thereby completing the ice making process in a short time, and a refrigerator having the same.

2. Description of the Related Art

Generally, a refrigerator is an apparatus that stores food in a refrigerated state or in a frozen state using cool air generated by freezing cycle components mounted in the refrigerator. The refrigerator includes a freezing compartment, in which an ice making device to make ice and an ice supplying device to supply the ice made by the ice making device to the outside are mounted.

The ice making device includes an ice making tray to receive water to be frozen, which is supplied from an external water source, and an ice separating motor to rotate the ice making tray such that the ice making tray is turned upside down, and therefore, the ice in the ice making tray falls into the ice supplying device. An example of conventional refrigerator is disclosed in U.S. Pat. No. 6,351,955, which provides a refrigerator that injects cool air to the lower part of an ice making tray in the horizontal direction to gradually cool water received in the ice making tray from the lower part thereof, thereby making transparent ice.

However, the cool air injected to the lower part of the ice making tray is dispersed in all directions, and therefore, the flow speed of the cool air is lowered in a short time. Furthermore, the cool air has high density, and therefore, the cool air has a tendency to fall. As a result, the cool air gradually falls although the cool air is injected in the horizontal direction. Consequently, a large amount of cool air is supplied to one side of the ice making tray which is adjacent to the cool air injection part, and therefore, the ice making process is satisfactorily performed. However, a small amount of cool air having low flow speed is supplied to the other side of the ice making tray which is located away from the cool air injection part, and therefore, the ice making process is not satisfactorily performed. As a result, it takes an extended time until the ice making process is completed at the other side of the ice making tray.

In addition, the conventional refrigerator can make transparent ice; however, the conventional refrigerator cannot rapidly make ice in a short time.

SUMMARY OF THE INVENTION

Therefore, in one aspect, the invention provides an ice making device that uniformly supplies cool air from one side to the other side of an ice making tray, thereby completing the ice making process in a reduced time, and a refrigerator having the same.

In another aspect of the invention, a refrigerator has an ice making device that controls ice making time as occasion demands.

In accordance with one aspect, the present invention provides an ice making device comprising: an ice making tray having ice making grooves opened at the upper sides thereof to receive water and a cool air flow channel disposed below the ice making grooves and along which cool air flows.

In one embodiment, the ice making tray is rotatably connected to an ice separating motor to generate a rotating force such that the ice making tray is turned upside down. The ice making device further comprises a cool air guide pipe selectively connectable to the cool air flow channel such that the cool air can be supplied to the cool air flow channel only when the ice making tray is positioned with the ice making grooves upward.

Generally, the ice making tray includes an ice making part having the ice making grooves and a cool air guide part to cover the lower surface of the ice making part while being a predetermined distance from the lower surface of the ice making part such that the cool air flow channel is defined between the ice making part and the cool air guide part, the cool air guide part having an inlet port, formed at one side thereof, to which the cool air guide pipe is connected such that the cool air is supplied to the cool air flow channel through the inlet port, and an outlet port formed, at the other side thereof, through which the cool air is discharged.

The cool air guide pipe is generally made of an elastically deformable material such that, when the ice making tray is positioned with the ice making grooves upward, a tip end of the cool air guide pipe protrudes into the cool air flow channel through the inlet port.

In general, the tip end of the cool air guide pipe, which is connected to the cool air flow channel, is formed in a zigzag shape such that the tip end of the cool air guide pipe is readily elastically deformed.

Typically, the ice making tray has a plurality of heat exchange fins formed at the lower surface of the ice making part, such that the heat exchange fins protrude into the cool air flow channel, to improve the efficiency of heat exchange between the ice making part and the cool air.

Generally, the ice making tray has a plurality of whirlpool induction fins protruding from the lower surface of the ice making part and extending in the direction perpendicular to the flow direction of the cool air to generate whirlpools at the upper part of the cool air flow channel.

Typically, the ice making part and the cool air guide part are made of an elastically deformable material such that the ice making part and the cool air guide part may be twisted, when the ice making part and the cool air guide part are rotated by the ice separating motor, to accomplish the ice separation.

Generally, the cool air guide part is made of a material that can be more easily elastically deformed than the ice making part.

In accordance with another aspect, the present invention provides a refrigerator comprising a refrigerator body having a freezing compartment defined therein, an evaporator mounted at the rear part of the freezing compartment, a guide duct mounted in front of the evaporator to disperse and supply cool air to upper and lower parts of the freezing compartment, and an ice making device including an ice making tray to receive water to be frozen, wherein the ice making tray has ice making grooves opened at the upper sides thereof to receive water and a cool air flow channel which is disposed below the ice making grooves to allow cool air to flow therealong.

In accordance with yet another aspect, the present invention provides a refrigerator comprising a refrigerator body having a freezing compartment defined therein, an evaporator mounted at the rear part of the freezing compartment, a guide duct mounted in front of the evaporator to disperse and supply cool air to upper and lower parts of the freezing compartment, and an ice making device including an ice making tray to receive water to be used to make ice, wherein the ice making device further includes an upper discharge port, through which cool air guided along the guide duct is discharged to an upper part of the ice making tray, a lower discharge port, through which cool air guided along the guide duct is discharged to a lower part of the ice making tray, and a damping unit mounted in the guide duct to selectively restrict the supply of cool air to the upper discharge port.

Generally, the upper discharge port and the lower discharge port are provided at tip ends of an upper nozzle and a lower nozzle extending from the ice making tray to the upper part and the lower part of the ice making tray, respectively.

Typically, the damping unit includes a damper rotatably mounted in the guide duct to selectively restrict the supply of the cool air to the upper discharge port.

Generally, the damping unit further includes a rod movable upward, by a solenoid, to rotate the damper in one direction, and an elastic member to elastically support the rod and restore the rod to its original position.

Additional aspects and/or advantages of the invention will be set forth in part in the description which follows and, in part, will be apparent from the description, or may be learned by practice of the invention.

BRIEF DESCRIPTION OF THE DRAWINGS

The patent or application file contains at least one drawing executed in color. Copies of this patent or patent application publication with color drawing(s) will be provide by the U.S. Patent and Trademark Office upon request and payment of the necessary fee. These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
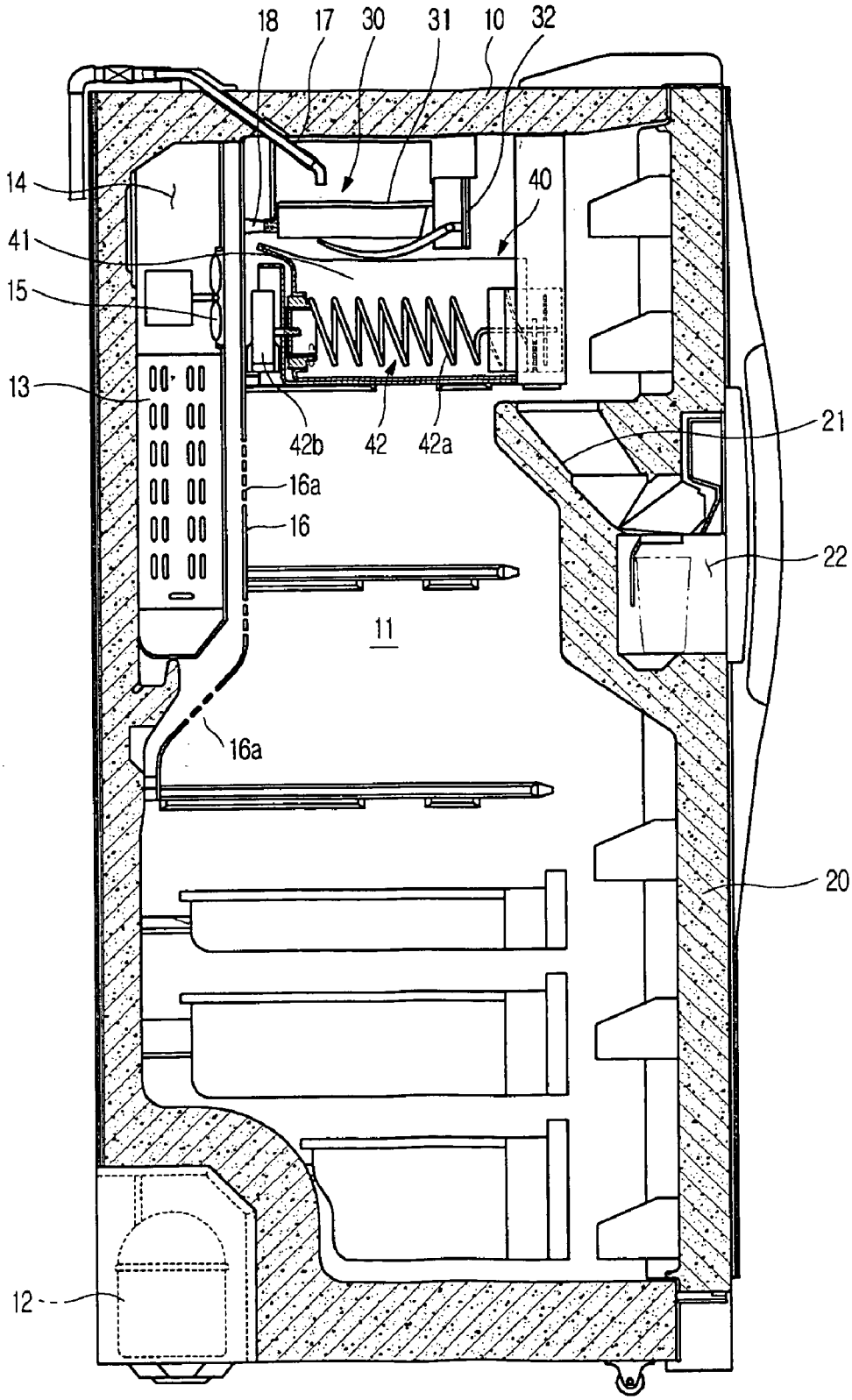
FIG. 1 is a sectional view schematically illustrating the construction of a refrigerator according to a first embodiment of the present invention.

Reference will now be made in detail to the embodiment of the present invention, examples of which are illustrated in the accompanying drawings, wherein like reference numerals refer to like elements throughout. The embodiments are described below to explain the present invention by referring to the figures.

First, a refrigerator according to a first embodiment of the present invention will be described in detail with reference to the accompanying drawings.

As shown in FIG. 1, the refrigerator having an ice making device according to the present invention includes a refrigerator body 10 forming the external appearance of the refrigerator and opened at the front part thereof to constitute a freezing compartment 11 in which food is stored and a door 20 hingedly coupled to one side of the refrigerator body 10 to open and close the freezing compartment 11. In the refrigerator body 10 are mounted freezing cycle components, such as a compressor 12, a condenser (not shown), an evaporator 13, and an expansion valve (not shown), to generate cool air such that the interior of the freezing compartment 11 can be cooled by the cool air generated from the freezing cycle components. In this embodiment, the compressor 12 is located at the lower part of the refrigerator body 10, and the evaporator 13 is located at the rear part of the freezing compartment 11.

At the rear part of the freezing compartment 11 are located a cooling compartment 14, in which the evaporator 13 is located, and a guide duct 16 extending vertically in front of the cooling compartment 14 to guide the cool air generated from the evaporator 13 such that the cool air can be uniformly dispersed and supplied to the upper and lower parts of the freezing compartment 11. In the cooling compartment 14 is mounted a cooling fan 15 to generate a suction force and a blowing force to the upper part of the evaporator 13 such that the cool air generated from the evaporator 13 may be circulated to the freezing compartment 11 through the guide duct 16.

At the upper part of the freezing compartment 11 of the refrigerator according to the present invention is mounted an ice making device 30 to make ice. Below the ice making device 30 is mounted an ice supplying device 40 to store ice made by the ice making device 30 and to discharge the ice to the outside if necessary. At the door 20 is provided a discharge guide duct 21, which communicates with the interior of the freezing compartment 11 to guide the discharge of the ice such that a user may remove the ice made by the ice making device 30 without opening the door 20. At the front part of the door 20 is provided an ice discharge unit 22, which is depressed inward to receive, readily, the ice discharged through the discharge guide duct 21.

The ice supplying device 40 includes an ice storage box 41 opened at the upper side thereof to store the ice falling from the ice making device 30 and an ice feeding unit 42 rotatably mounted in the ice storage box 41 to feed the ice to the discharge guide duct 21 side. The ice feeding unit 42 includes a feeding wing **42*a* formed in a spiral shape and rotatable so as to feed the ice to the discharge guide duct 21 side and a feeding motor 42***b* to generate a rotating force necessary to rotate the feeding wing 42*a*.

Figure 2:
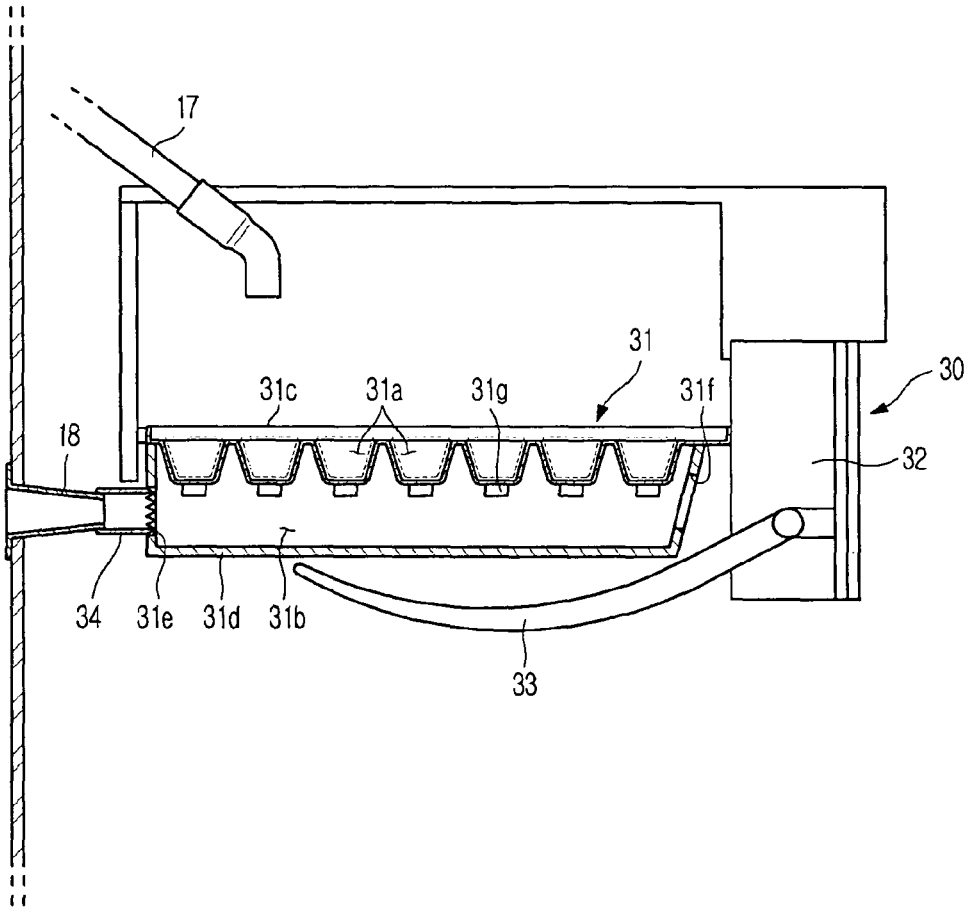
FIG. 2 is a sectional view of an ice making device applied to the refrigerator according to the first embodiment of the present invention.

As shown in FIG. 2, the ice making device 30 includes an ice making tray 31 to receive water to be frozen, an ice separating motor 32 to rotate the ice making tray 31 such that the ice making tray 31 is turned upside down, and therefore, ice made in the ice making tray 31 is separated from the ice making tray 31 and falls into the ice supplying device 40, and an ice amount detecting lever 33 to detect the amount of ice received in the ice storage box 41 such that the operation of the ice making device 30 can be turned on or off. Above the ice making device 30 is disposed a water supply pipe 17 to supply water from an external water source to the ice making tray 31. In this case, the ice making tray 31 is made of an elastically deformable material such that the ice making tray 31 can be twisted, when the ice making tray 31 is rotated by the ice separating motor 32, so as to accomplish the separation of the ice made in the ice making tray 31.

The ice making device 30 according to the present invention further includes a cool air flow channel 31*b* formed at the lower part of the ice making tray 31 along which cool air flows such that the water received in the ice making tray 31 is uniformly cooled, and therefore, the ice making process is completed in a reduced time.

In order to form the cool air flow channel 31*b*, the ice making tray 31 includes an ice making part 31*c* having a plurality of ice making grooves 31*a* opened at the upper sides thereof to receive water to be frozen and arranged in a matrix structure and a cool air guide part 31*d* to cover the lower surface of the ice making part 31*c* while being spaced a predetermined distance from the lower surface of the ice making part 31*c* such that the cool air flow channel 31*b* is defined between the ice making part 31*c* and the cool air guide part 31*d*. At one side of the cool air guide part 31*d* is provided an inlet port 31*e*, through which cool air is supplied to the cool air flow channel 31*b*. At the other side of the cool air guide part 31*d* is provided an outlet port 31*f*, through which the cool air flowing along the cool air flow channel 31*b* is discharged out of the cool air flow channel 31*b*.

Also, the cool air guide part 31*d* and the ice making part 31*c* are made of an elastically deformable material such that the cool air guide part 31*d* and the ice making part 31*c* can be twisted by the ice separating motor 32 to accomplish the ice separation. In this case, since the cool air guide part 31*d* is spaced a longer distance from a shaft of the ice separating motor 32, which is the center of rotation, than the ice making part 31*c* is, it is necessary for the cool air guide part 31*d* to be elastically deformed by a larger amount than the ice making part 31*c*. Consequently, the cool air guide part 31*d* is made of a material that may be more easily elastically deformed than the ice making part 31*c*.

As a result, cool air introduced through the inlet port 31*e* provided at one side of the cool air guide part 31*d* is guided horizontally along the cool air flow channel 31*b*, and is then discharged out of the cool air flow channel 31*b* through the outlet port 31*f* provided at the other side of the cool air guide part 31*d*. Consequently, the cool air is uniformly supplied from one side to the other side of the ice making part 31*c*. Therefore, the ice making part 31*c* is uniformly cooled with the result that the ice making process is completed in a reduced time.

Figure 6:
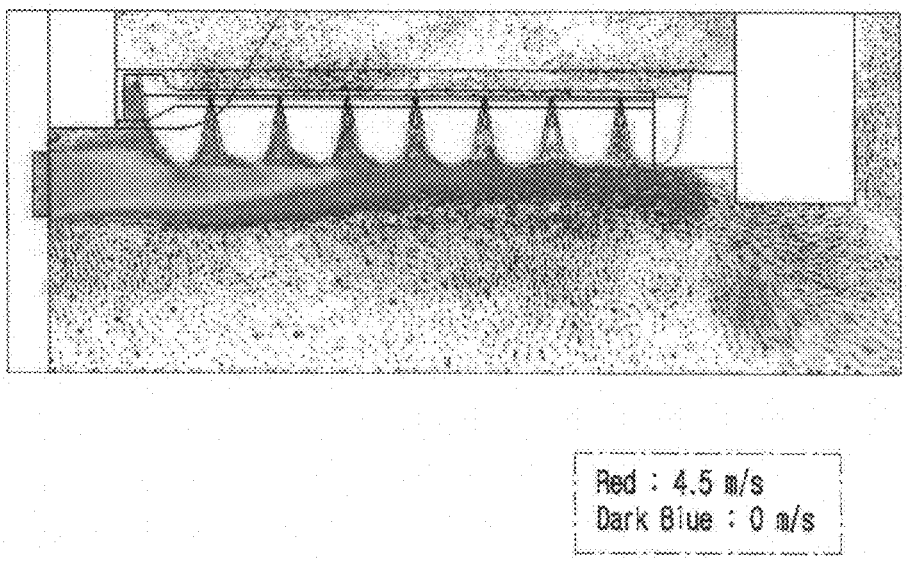
FIG. 6 is a view illustrating the flow speed of cool air in the ice making device when no cool air flow channel is provided at the lower part of the ice making tray.
Figure 7:
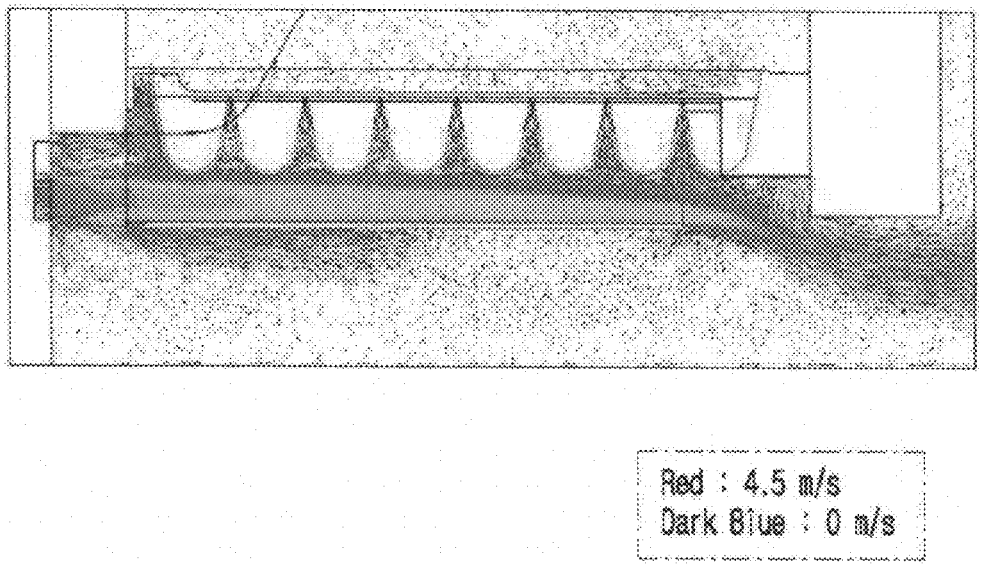
FIG. 7 is a view illustrating the flow speed of cool air in the ice making device when a cool air flow channel is provided at the lower part of the ice making tray.

FIG. 6 is a view illustrating the flow speed of cool air in the ice making device 30 when the cool air flow channel 31*b* is not provided at the lower part of the ice making tray 31, and FIG. 7 is a view illustrating the flow speed of cool air in the ice making device 30 when the cool air flow channel 31*b* is provided at the lower part of the ice making tray 31.

It can be seen from FIGS. 6 and 7 that the flow speed of the cool air is rapidly reduced while the cool air flows from one side to the other side of the ice making tray 31 along the lower part of the ice making tray 31 when the cool air flow channel 31*b* is not provided at the lower part of the ice making tray 31, whereas the flow speed of the cool air is maintained at a certain level or more when the cool air flow channel 31*b* is provided at the lower part of the ice making tray 31. Consequently, when the cool air flow channel 31*b* is provided at the lower part of the ice making tray 31, a sufficient amount of cool air can be supplied to the other side of the ice making tray 31, whereby the ice making process is completed in a reduced time.

In order to supply cool air to the cool air flow channel 31*b* as described above, a cool air guide pipe 34 is connected to the inlet port 31*e* to receive cool air from the guide duct 16 and to supply the received cool air to the cool air flow channel 31*b*. In this embodiment, the cool air guide pipe 34 is selectively connected to the inlet port 31*e* such that the cool air can be supplied to the cool air flow channel 31*b* through the inlet port 31*e* only when the ice making tray 31 is positioned with the ice making grooves 31*a* upward.

Figure 3:
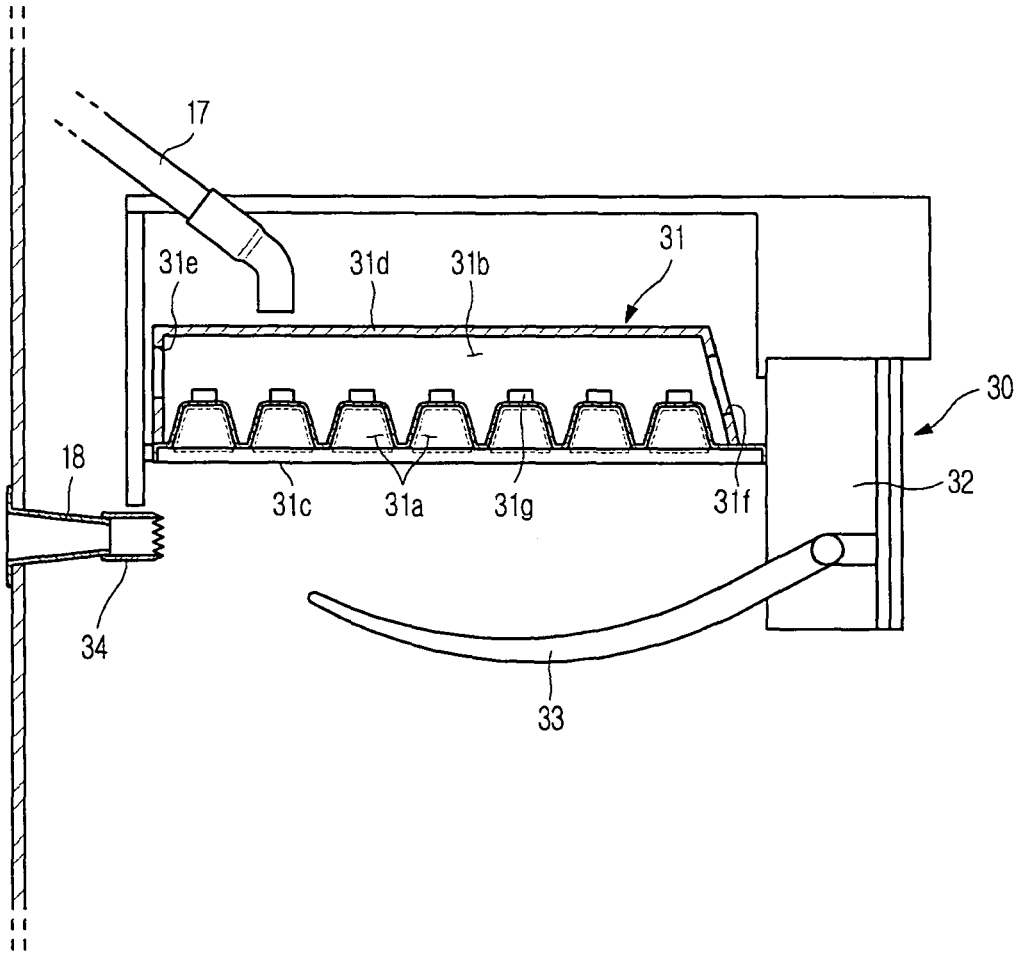
FIG. 3 is a sectional view illustrating an ice separating operation performed by the ice making device applied to the refrigerator according to the first embodiment of the present invention.

To this end, the cool air guide pipe 34 is made of an elastic material, such as rubber, and the tip end of the cool air guide pipe 34 is fitted in the cool air flow channel 31*b* through the inlet port 31*e*. Consequently, when the ice making tray 31 is rotated by the ice separating motor 32 so as to perform the ice separating operation and is turned upside down, as shown in FIG. 3, the cool air guide pipe 34 is elastically deformed and then elastically restored. As a result, the cool air guide pipe 34 is disconnected from the inlet port 31*e*, and therefore, the supply of cool air to the cool air flow channel 31*b* is interrupted. When the ice separating operation is completed, and the ice making tray is returned to its original position so as to perform an ice making process, and the cool air guide pipe 34 is elastically deformed and then elastically restored. As a result, the cool air guide pipe 34 is connected again to the inlet port 31*e*, and therefore, the supply of cool air to the cool air flow channel 31*b* is resumed. In this embodiment, the tip end of the cool air guide pipe 34, which protrudes into the cool air flow channel 31*b*, is formed in a zigzag shape such that the tip end of the cool air guide pipe 34 may be separated from or inserted into the inlet port 31*e* while the tip end of the cool air guide pipe 34 is readily elastically deformed and elastically restored.

In order that the cool air flows along the cool air flow channel 31*b* at a specific speed or a greater speed, an injection nozzle 18 is formed at the guide duct 16. The injection nozzle 18 is formed such that the inner diameter is gradually decreased to increase the flow speed of the cool air passing through the injection nozzle 18. The cool air guide pipe 34 is connected to the tip end of the injection nozzle 18.

Figure 4:
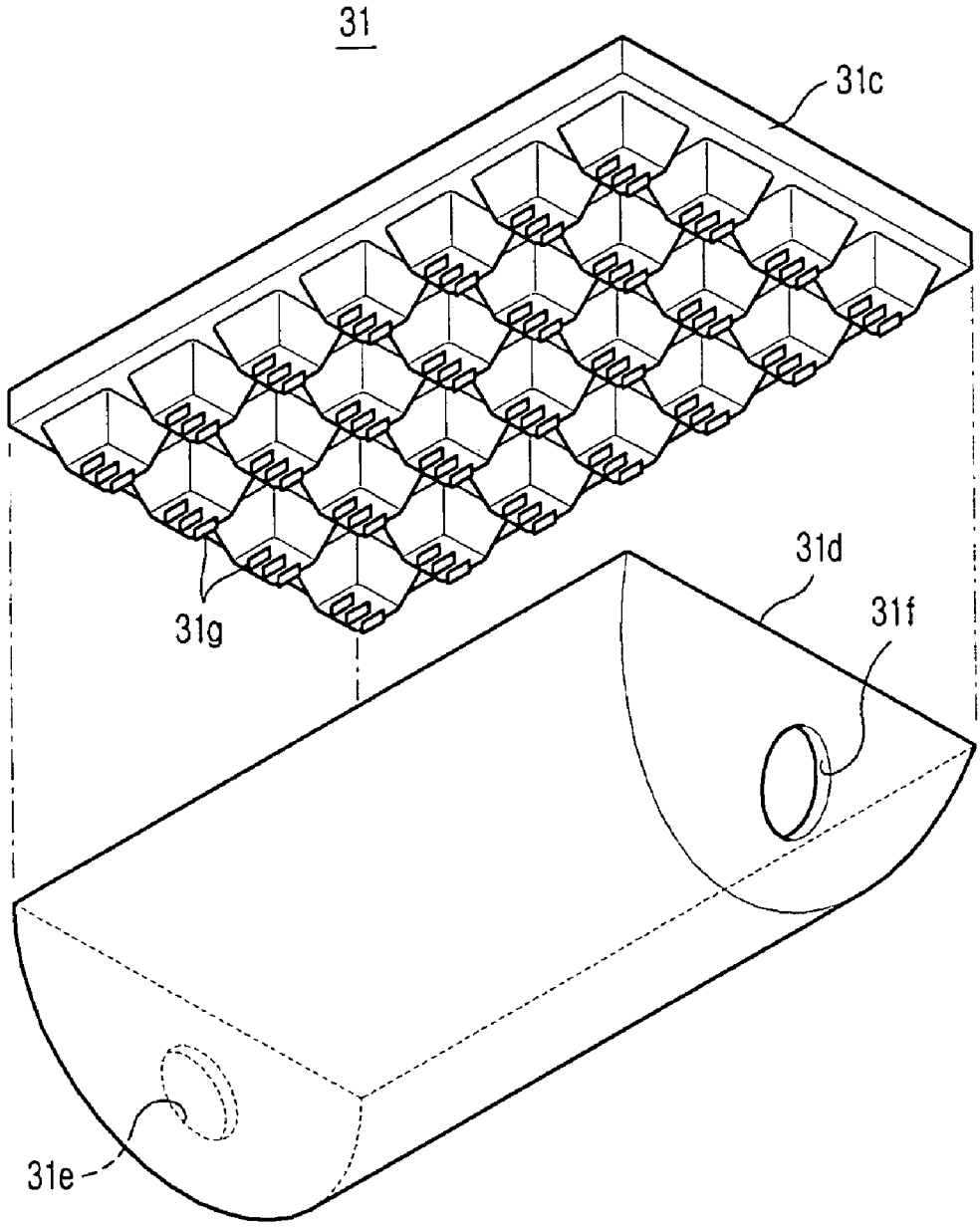
FIG. 4 is an exploded perspective view illustrating an ice making tray of the ice making device applied to the refrigerator according to the first embodiment of the present invention.

In this embodiment, in order that the ice making process may be more efficiently performed by the cool air flowing along the cool air flow channel 31*b*, a plurality of heat exchange fins 31*g* are formed at the lower surface of the ice making part 31*c*, such that the heat exchange fins 31*g* protrude downward, as shown in FIG. 4, to accomplish more efficient heat exchange between the ice making part and the cool air.

Figure 5:
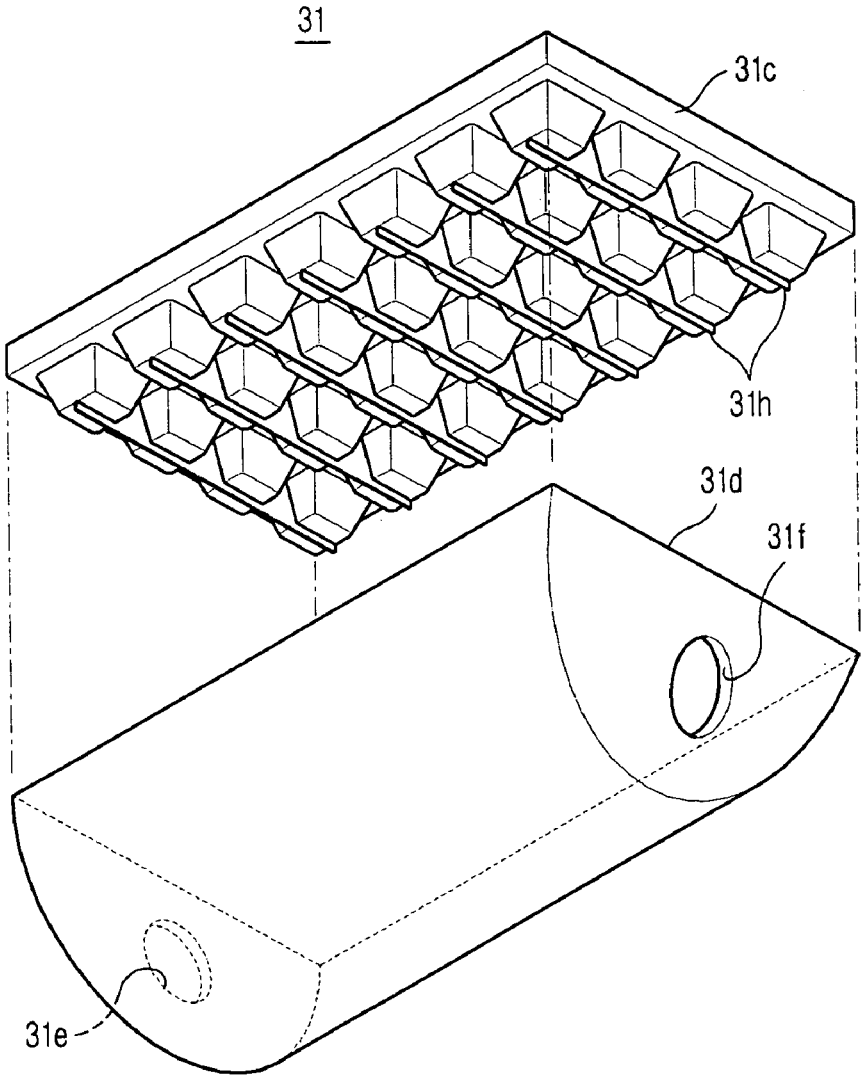
FIG. 5 is an exploded perspective view illustrating an ice making tray of an ice making device applied to a refrigerator according to a second embodiment of the present invention.

In this embodiment, the heat exchange fins 31*g* are formed at the lower surface of the ice making part 31*c*. However, it is also possible to form whirlpool induction fins 31*h* at the lower surface of the ice making part 31*c*, such that the whirlpool induction fins 31 h extend to the upper part of the cool air flow channel 31*b*, as shown in FIG. 5, to generate whirlpools at the upper part of the cool air flow channel 31*b*. The whirlpool induction fins 31*h* extend in the direction perpendicular to the flow direction of the cool air. Some of the cool air flowing along the cool air flow channel 31*b* flows in whirls at the upper part of the cool air flow channel 31*b* due to the whirlpool induction fins 31*h*. Consequently, the heat exchange between the ice making part 31*c* and the cool air is more efficiently accomplished.

Figure 8:
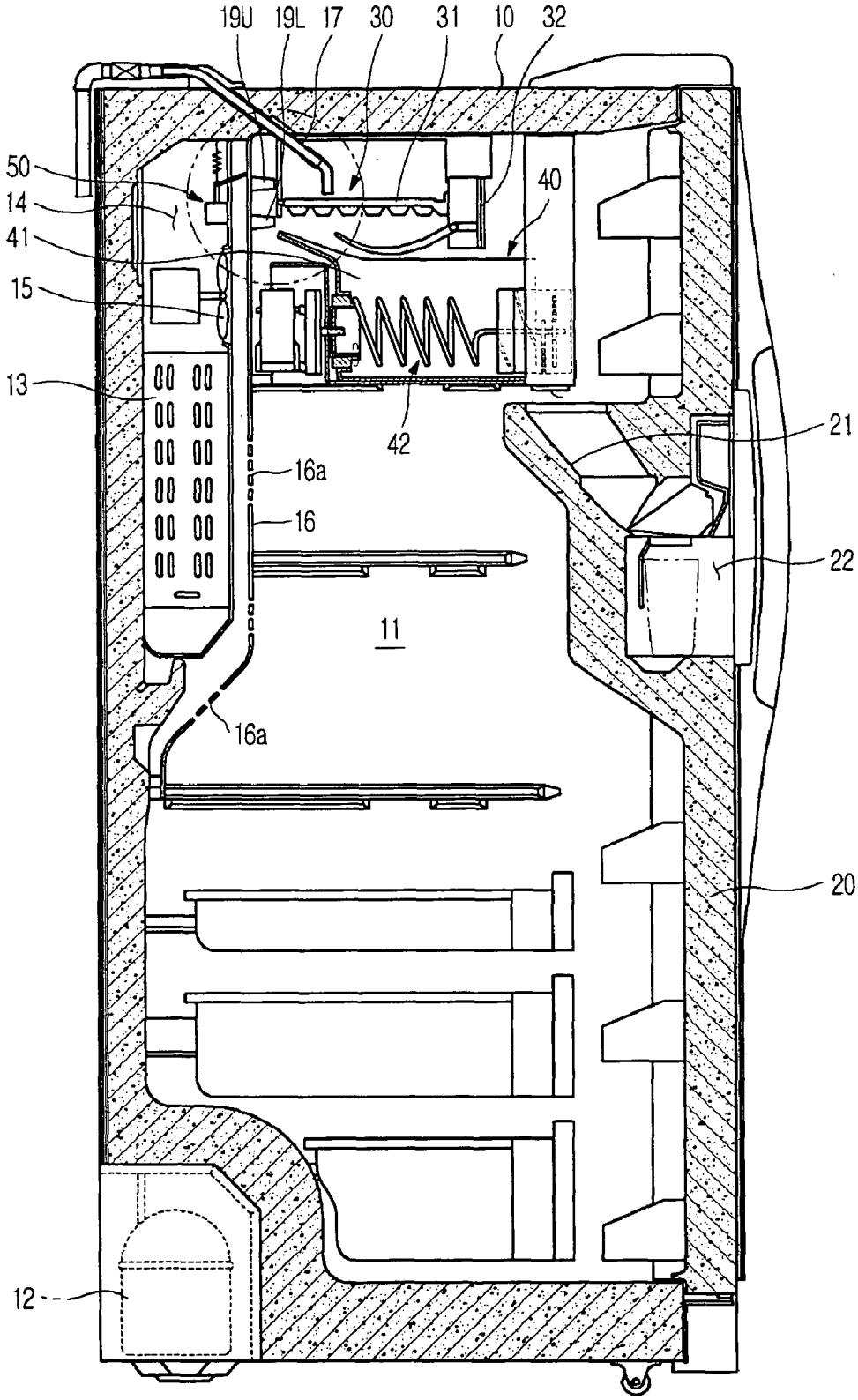
FIG. 8 is a sectional view schematically illustrating the construction of a refrigerator according to a third embodiment of the present invention.

FIG. 8 is a view illustrating a refrigerator having an ice making device according to a third embodiment of the present invention.

The refrigerator having the ice making device according to the third embodiment of the present invention is constructed to control ice making time as occasion demands. Specifically, the refrigerator is constructed to perform a transparent ice making mode in which water is slowly frozen for a relatively long time to obtain transparent ice and a rapid ice making mode in which water is rapidly frozen in a relatively short time to obtain common ice.

Figure 9:
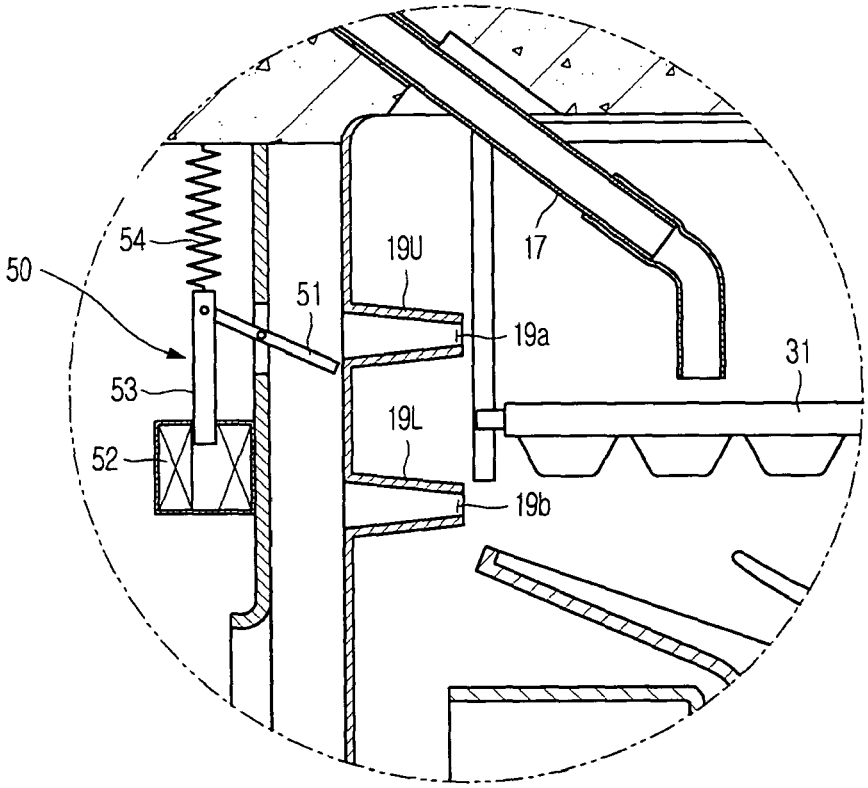
FIG. 9 is a sectional view illustrating the operation of a damping unit when a transparent ice making mode is performed by the refrigerator according to the third embodiment of the present invention.

To this end, as shown in FIG. 9, the guide duct 16 is provided at a position corresponding to the upper part of the ice making tray 31 with an upper discharge port 19*a*, through which the cool air is discharged to the upper part of the ice making tray 31, and is provided at a position corresponding to the lower part of the ice making tray 31 with a lower discharge port 19*b*, through which the cool air is discharged to the lower part of the ice making tray 31. In the guide duct 16 is mounted a damping unit 50 to selectively restrict the supply of cool air to the upper discharge port 19*a*. In this embodiment, the upper discharge port 19*a* and the lower discharge port 19*b* are integrally formed with the guide duct 16 such that the upper discharge port 19*a* and the lower discharge port 19*b* protrude forward from the guide duct 16. The upper discharge port 19*a* and the lower discharge port 19*b* are provided at the tip ends of an upper nozzle 19U and a lower nozzle 19L, which are formed such that the inner diameters of the upper nozzle 19U and the lower nozzle 19L are gradually decreased to increase the flow speed of the cool air passing through the upper nozzle 19U and the lower nozzle 19L, respectively.

Figure 10:
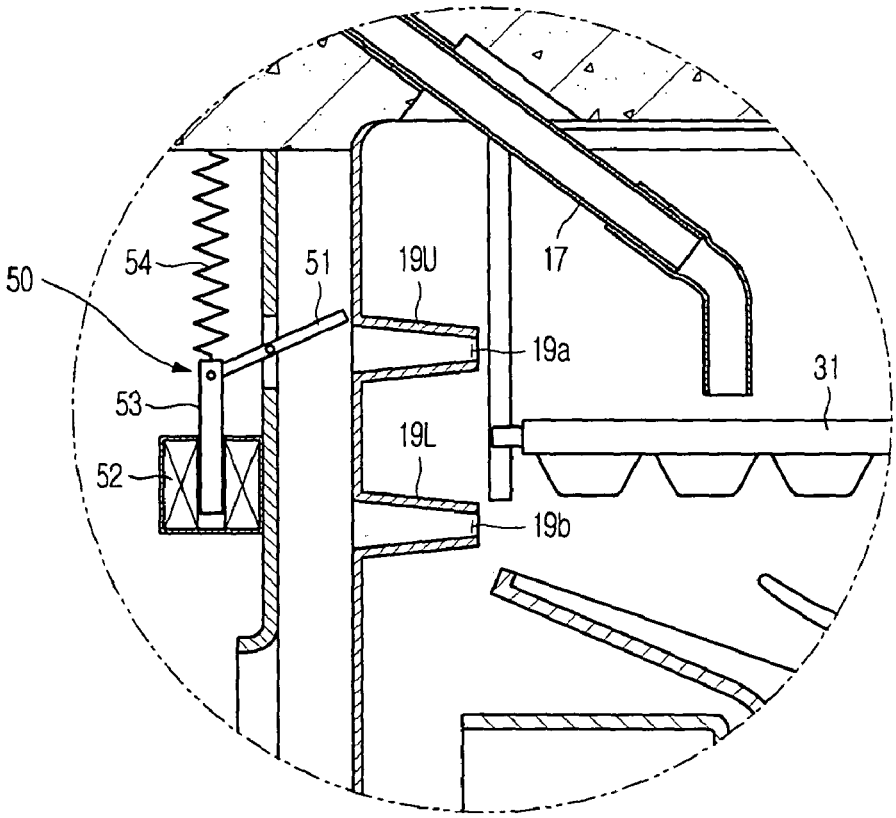
FIG. 10 is a sectional view illustrating the operation of the damping unit when a rapid ice making mode is performed by the refrigerator according to the third embodiment of the present invention.

Consequently, when the transparent ice making mode, in which water is slowly frozen for a relatively long time to obtain transparent ice, is performed, the damping unit 50 restricts the supply of the cool air to the upper discharge port 19*a* such that the cool air is transmitted to the lower part of the ice making tray 31 only through the lower discharge port 19*b*. As a result, the cool air is transmitted to the water received in the ice making tray 31 through the ice making tray 31, whereby the water received in the ice making tray 31 is slowly frozen into transparent ice. When the rapid ice making mode, in which water is rapidly frozen in a relatively short time to obtain common ice, is performed, as shown in FIG. 10, the damping unit 50 allows the supply of the cool air to the upper discharge port 19*a* such that the cool air is transmitted to the upper and lower parts of the ice making tray 31 through the upper discharge port 19*a* and the lower discharge port 19*b*. As a result, the cool air is transmitted to the lower part of the water received in the ice making tray 31 through the ice making tray 31, and, at the same time, the cool air supplied to the upper part of the ice making tray 31 is transmitted to the upper part of the water received in the ice making tray 31, whereby the water received in the ice making tray 31 is slowly frozen into transparent ice.

The damping unit 50 includes a damper 51 rotatably mounted in the guide duct 16 to selectively restrict the supply of the cool air to the upper discharge port 19*a*, a rod 53 movable upward, by a solenoid 52, to rotate the damper 51, and an elastic member 54 to elastically support the rod 53 and restore the rod 53 to its original position when a force transmitted to the rod 53 by the solenoid 52 is released.

Consequently, in the transparent ice making mode, the rod 53 is moved upward, by the solenoid 52, to rotate the damper 51, and therefore, the damper 51 restricts the supply of the cool air to the upper discharge port 19*a*. As a result, the cool air is transmitted to the lower part of the ice making tray 31 only through the lower discharge port 19*b*. In the rapid ice making mode, on the other hand, the rod is moved downward, by the elastic force of the elastic member 54, to restore the damper 51 to its original position. As a result, the cool air is transmitted to the upper and lower parts of the ice making tray 31 through the upper discharge port 19*a* and the lower discharge port 19*b*.

As is apparent from the above description, the refrigerator having the ice making device according to the present invention is characterized in that the cool air flow channel is formed at the lower part of the ice making tray. Consequently, cool air is uniformly supplied from one side to the other side of the ice making tray, and therefore, the ice making process is completed in a short time.

Furthermore, the refrigerator having the ice making device according to the present invention is characterized in that the guide duct is provided with the upper discharge port, through which the cool air is discharged to the upper part of the ice making tray, and the lower discharge port, through which the cool air is discharged to the lower part of the ice making tray, and the damping unit is mounted in the guide duct to selectively control the supply of the cool air to the upper discharge port. Consequently, the refrigerator having the ice making device according to the present invention may selectively perform the rapid ice making mode to make common ice in a short time or the transparent ice making mode to make transparent ice.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising a refrigerator body having a freezing compartment defined therein, an evaporator mounted at a rear part of the freezing compartment, a guide duct mounted in front of the evaporator to disperse and supply cool air to upper and lower parts of the freezing compartment, and an ice making device including an ice making tray to receive water to be frozen, wherein the ice making tray has ice making grooves opened at the upper sides thereof to receive water and a cool air flow channel disposed below the ice making grooves and along which cool air flows, the ice making tray is rotatably connected to an ice separating motor to generate a rotating force such that the ice making tray is turned upside down, the ice making device further includes a cool air guide pipe selectively connectable to the cool air flow channel such that the cool air is supplied to the cool air flow channel only when the ice making tray is positioned with the ice making grooves upward, and the ice making tray includes an ice making part having the ice making grooves and a cool air guide part to cover a lower surface of the ice making part while being located a predetermined distance from the lower surface of the ice making part such that the cool air flow channel is defined between the ice making part and the cool air guide part, the cool air guide part having an inlet port, formed at one side thereof, to which a cool air guide pipe is connected such that the cool air is supplied to the cool air flow channel through the inlet port, and an outlet port formed, at the other side thereof, through which the cool air is discharged.

2. The refrigerator according to claim 1, wherein the cool air guide pipe is made of an elastically deformable material such that, when the ice making tray is positioned with the ice making grooves upward, a tip end of the cool air guide pipe protrudes into the cool air flow channel through the inlet port.

3. The refrigerator according to claim 2, wherein the tip end of the cool air guide pipe, which is connected to the cool air flow channel, is formed in a zigzag shape such that the tip end of the cool air guide pipe is readily elastically deformed.

4. The refrigerator according to claim 1, wherein the ice making tray has a plurality of heat exchange fins formed at the lower surface of the ice making part, such that the heat exchange fins protrude into the cool air flow channel, to improve an efficiency of heat exchange between the ice making part and the cool air.

5. The refrigerator according to claim 1, wherein the ice making tray has a plurality of whirlpool induction fins protruding from the lower surface of the ice making part into the cool air flow channel and having a width in a direction perpendicular to a flow direction of the cool air to generate whirlpools at an upper part of the cool air flow channel.

6. The refrigerator according to claim 2, wherein the ice making device further includes an injection nozzle extending from a guide duct to an inlet port side and having an inner diameter gradually decreased to increase a flow speed of the cool air passing therethrough, the cool air guide pipe being connected to a tip end of the injection nozzle.

7. The refrigerator according to claim 1, wherein the ice making part and the cool air guide part are made of an elastically deformable material such that the ice making part and the cool air guide part are twisted, when the ice making part and the cool air guide part are rotated by the ice separating motor, accomplishing the ice separation.

8. The refrigerator according to claim 7, wherein the cool air guide part is made of a material that is more easily elastically deformed than the ice making part.

9. The refrigerator according to claim 1, further including an ice storage box opened at an upper side thereof to store ice falling from the ice making device.

10. The refrigerator according to claim 9, further including a door hingedly coupled to one side of the refrigerator body to open and close the freezing compartment and a discharge guide duct, which communicates with an interior of the freezing compartment to guide discharge of ice such that a user may remove the ice made by the ice making device without opening the door.

11. The refrigerator according to claim 10, further including an ice feeding unit rotatably mounted in the ice storage box to feed the ice to a discharge guide duct side, wherein the ice feeding unit includes a feeding wing formed in a spiral shape and rotatable so as to feed the ice to a discharge guide duct side and a feeding motor to generate a rotating force to rotate the feeding wing.

12. The refrigerator according to claim 11, further including an ice discharge unit, depressed inward at a front part of the door, to receive the ice discharged through the discharge guide duct.

13. The refrigerator according to claim 9, further including an ice amount detecting lever to detect an amount of ice received in the ice storage box to turn on or off operation of the ice making device.

14. A refrigerator comprising a refrigerator body having a freezing compartment defined therein, an evaporator mounted at a rear part of the freezing compartment, a guide duct mounted in front of the evaporator to disperse and supply cool air to upper and lower parts of the freezing compartment, and an ice making device including an ice making tray to receive water to be used to make ice, wherein the ice making device further includes an upper discharge port, through which cool air guided along the a duct is discharged to an upper part of the ice making tray, a lower discharge port, through which cool air guided along the guide duct is discharged to a lower part of the ice making tray, and a damping unit mounted in the guide duct to selectively restrict a supply of the cool air to the upper discharge port.

15. The refrigerator according to claim 14, wherein the upper discharge port and the lower discharge port are provided at tip ends of an upper nozzle and a lower nozzle extending from the ice making tray to an upper part and the lower part of the ice making tray, respectively.

16. The refrigerator according to claim 14, wherein the damping unit includes a damper rotatably mounted in the guide duct to selectively restrict the supply of the cool air to the upper discharge port.

17. The refrigerator according to claim 16, wherein the damping unit further includes a rod movable upward, by a solenoid, to rotate the damper in one direction, and an elastic member to elastically support the rod and restore the rod to an original position.

* * * * *